US012704059B2

(12) United States Patent
Hickson et al.

(10) Patent No.: US 12,704,059 B2
(45) Date of Patent: Aug. 11, 2026

(54) WELLBORE SURVEYING USING A TILTED SURVEY SENSOR

(71) Applicant: Schlumberger Technology Corporation, Sugar Land, TX (US)

(72) Inventors: Alexander Hickson, Wiltshire (GB); Makito Katayama, Clamart (FR); Edward Richards, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/893,410

(22) Filed: Sep. 23, 2024

(65) Prior Publication Data

US 2026/0085607 A1 Mar. 26, 2026

(51) Int. Cl.
*E21B 47/0228* (2012.01)

(52) U.S. Cl.
CPC ..... *E21B 47/0228* (2020.05)

(58) Field of Classification Search
CPC .. E21B 47/022; E21B 47/024; E21B 47/0228; G01V 3/26
See application file for complete search history.

(56) References Cited

U.S. PATENT DOCUMENTS 4,265,028 A * 5/1981 Van Steenwyk ..... E21B 47/022 33/312
7,093,370 B2 8/2006 Hansberry
9,804,288 B2 * 10/2017 Estes ..... G01V 3/26
10,466,385 B2 11/2019 Smidth
11,692,432 B2 * 7/2023 Phillips ..... E21B 44/00 175/24
2005/0199425 A1 * 9/2005 Estes ..... H04L 63/0272 175/50
2012/0125077 A1 5/2012 Rodney
2013/0151157 A1 * 6/2013 Brooks ..... E21B 47/022 702/9
2013/0338924 A1 * 12/2013 Fang ..... G01V 3/18 702/9
2015/0252623 A1 * 9/2015 Nero ..... E21B 47/0228 175/45
2015/0330210 A1 * 11/2015 Lozinsky ..... E21B 47/024 73/152.46
2018/0298743 A1 * 10/2018 Sullivan ..... E21B 47/022
2020/0408085 A1 * 12/2020 Lloyd ..... E21B 47/022
2021/0254448 A1 * 8/2021 Phillips ..... E21B 47/022
2025/0003328 A1 * 1/2025 Avdeev ..... E21B 47/022

FOREIGN PATENT DOCUMENTS

EP 3640428 A1 4/2020

* cited by examiner

*Primary Examiner* — Kipp C Wallace
(74) *Attorney, Agent, or Firm* — Jeffrey D. Frantz

(57) ABSTRACT

A method for surveying a wellbore includes rotating a downhole tool having a tilted survey sensor in the wellbore. The tilted survey sensor has a sensory axis that is rotationally offset from a longitudinal axis of the downhole tool and is used to make sensor measurements while rotating the downhole tool in the wellbore. The sensor measurements are fit with a sinusoidal fitting function to obtain first and second fitting parameters. A wellbore survey parameter such as wellbore inclination or wellbore azimuth is computed from the first and second fitting parameters.

6 Claims, 5 Drawing Sheets

WELLBORE SURVEYING USING A TILTED SURVEY SENSOR

FIELD

Disclosed embodiments relate generally to downhole surveying tools and methods and more particularly to a downhole surveying method and apparatus utilizing a tilted survey sensor.

BACKGROUND

Wellbore surveying measurements are commonly made during a drilling operation, for example, at discrete locations along the axis of the wellbore (static measurements) or continuously while drilling. Static measurements are commonly assembled into a survey of the well and used to calculate a three-dimensional well path (e.g., using the minimum curvature or other curvature assumptions). Dynamic measurements may also be assembled into a survey of the well and are further commonly used in automated steering routines.

Wellbore surveying measurements are commonly made using triaxial accelerometer and triaxial magnetometer measurements. Wellbore inclination is commonly derived (computed) from tri-axial accelerometer measurements of the earth's gravitational field. Wellbore azimuth (also commonly referred to as magnetic azimuth) is commonly derived from a combination of tri-axial accelerometer and tri-axial magnetometer measurements of the earth's gravitational and magnetic fields. While such surveying measurements have long been commercially serviceable, there is room for further improvement. For example, in some operations it may be advantageous to reduce the total sensor count (reduce the number of sensors required to obtain the survey) or to provide measurement redundancy and error checking.

SUMMARY

A method for surveying a wellbore is disclosed. The method includes rotating a downhole tool in the wellbore. The downhole tool includes a tilted survey sensor having a sensory axis that is rotationally offset from a longitudinal axis of the downhole tool. The tilted survey sensor is used to make sensor measurements while rotating the downhole tool in the wellbore. The sensor measurements are fit with a sinusoidal fitting function to obtain first and second fitting parameters. A wellbore survey parameter such as wellbore inclination or wellbore azimuth is computed from the first and second fitting parameters.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Example embodiments include a downhole surveying tool and a method for surveying a wellbore. An example method includes rotating a downhole tool in the wellbore. The downhole tool includes a tilted survey sensor having a sensory axis that is rotationally offset from a longitudinal axis of the downhole tool. The tilted survey sensor is used to make sensor measurements while rotating the downhole tool in the wellbore. The sensor measurements are fit with a sinusoidal fitting function to obtain first and second fitting parameters. A wellbore survey parameter such as wellbore inclination or wellbore azimuth is computed from the first and second fitting parameters.

Figure 1:
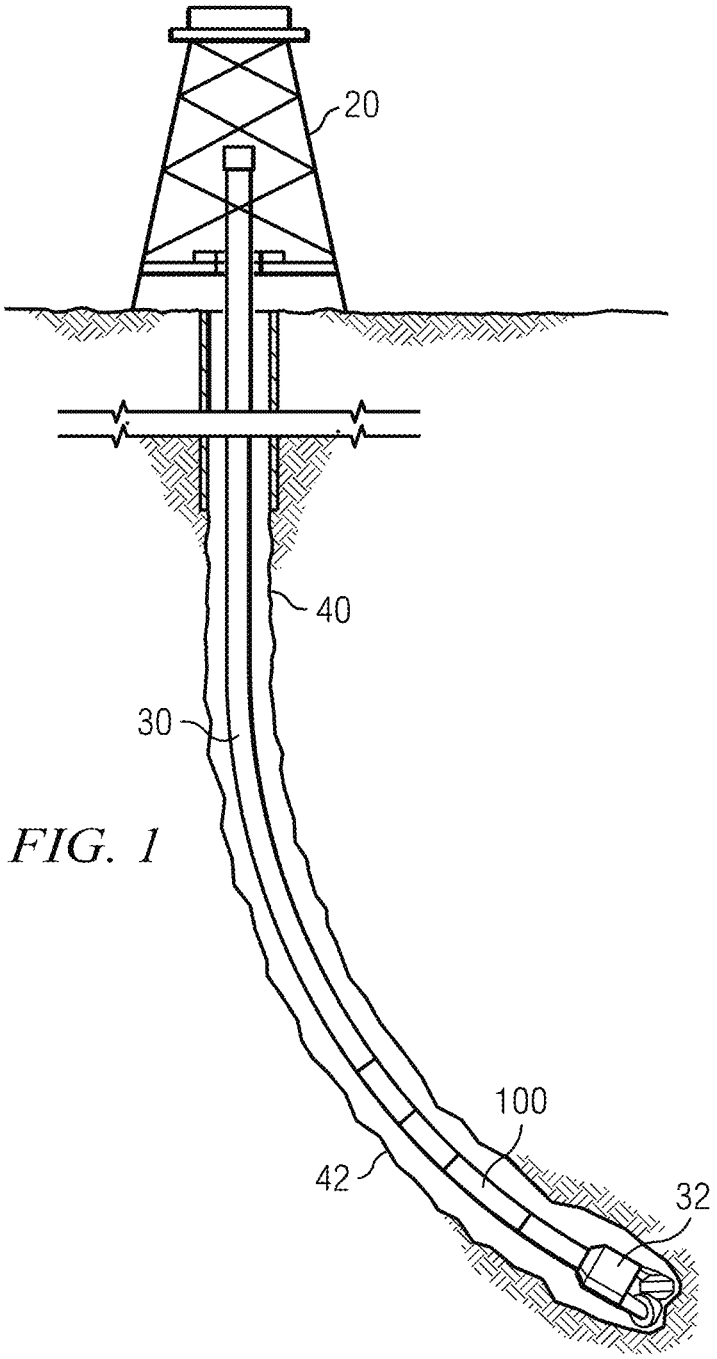
FIG. 1 depicts a drilling rig on which disclosed embodiments may be utilized.

FIG. 1 depicts an example drilling rig 20 including a downhole tool 100 configured for making downhole surveying measurements using a single accelerometer and/or a single magnetometer. As described in more detail below the downhole tool 100 may be a measurement while drilling (MWD) tool or a steering tool (such as a rotary steerable tool) that is configured to rotate in a wellbore 40. The drilling rig 20 may be positioned over a subterranean formation (not shown) and may be configured for drilling a geothermal well or a hydrocarbon exploration and/or production well. The rig 20 may include, for example, a derrick and a hoisting apparatus (also not shown) for raising and lowering a drill string 30, which, as shown, extends into wellbore 40 and includes the downhole tool 100. The drill string 30 may further include other tools, for example, a mud motor or one or more logging while drilling (LWD) tools. It will be appreciated that the disclosed embodiments are not limited to any particular drill string or bottom hole assembly (BHA) configuration.

The wellbore 40 may be formed in and thereby penetrate subsurface formations by rotary drilling or slide drilling in a manner that is well-known to those of ordinary skill in the art (e.g., via well-known directional drilling techniques). For example, the drill string 30 may be rotated at the surface and/or via a downhole deployed mud motor to drill the well. A pump may deliver drilling fluid to the interior of the drill string 30 thereby causing the drilling fluid to flow downwardly through the drill string 30. The drilling fluid exits the drill string 30, e.g., via ports in the drill bit 32, and then circulates upwardly through the annulus between the outside of the drill string 30 and the wall of the wellbore 40. In this known manner, the drilling fluid lubricates the drill bit 32 and carries formation cuttings uphole to the surface. A steering tool (e.g., a rotary steerable tool) may be configured to steer (or turn) the direction of drilling to form a curved wellbore section, for example, as depicted at 42. The sensor (s) deployed in the downhole tool 100 may be configured to measure the wellbore attitude (the wellbore inclination and the wellbore azimuth) while drilling.

It will be understood that the disclosed embodiments are not limited to use with an on-shore rig 20 as illustrated on FIG. 1. The disclosed embodiments are equally well suited for use with either onshore or offshore subterranean operations.

Figure 2A:
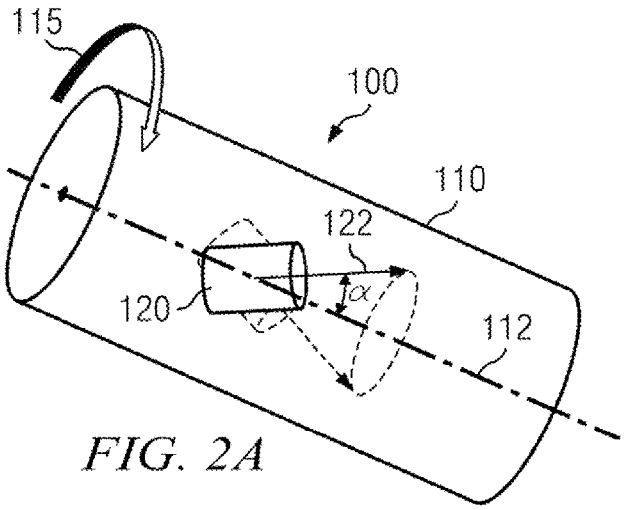
FIGS. 2A and 2B (collectively FIG. 2) schematically depict example embodiments of the downhole tool shown on FIG. 1.
Figure 2B:
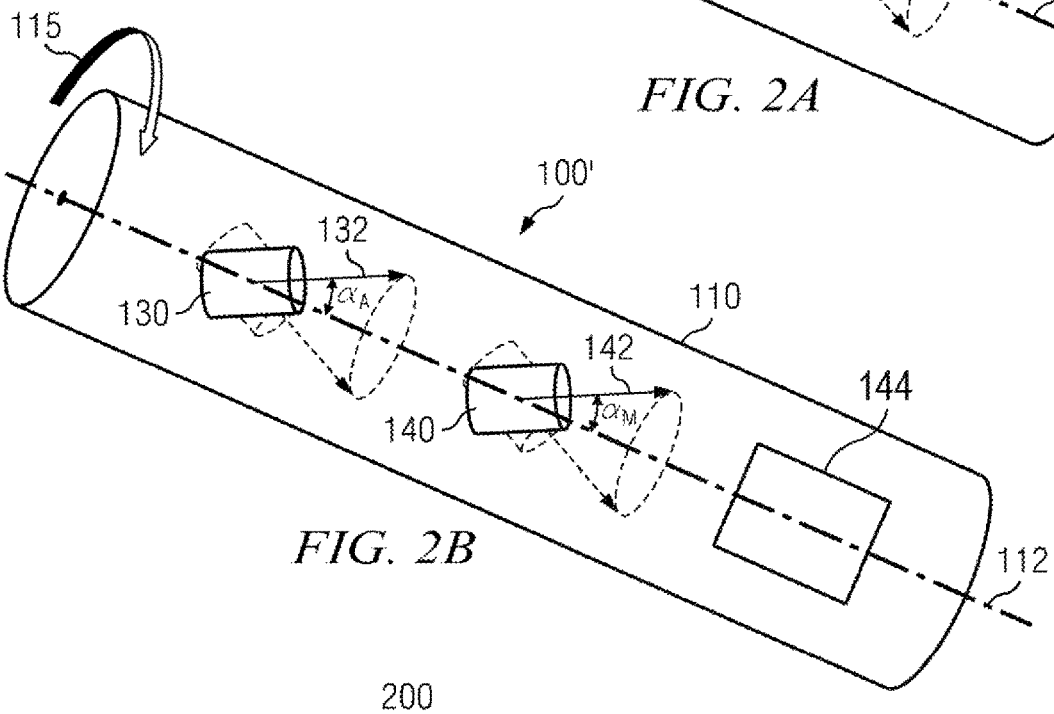

FIGS. 2A and 2B (collectively FIG. 2) schematically depict example embodiments of the downhole tool 100, 100' described above with respect to FIG. 1. As noted above, the downhole tool 100, 100' may be an MWD tool or a rotary steerable tool. In the embodiment depicted in FIG. 2A, downhole tool 100 includes a survey sensor 120 deployed in a drill collar 110. The drill collar 110 is configured to rotate with the drill string 30 as indicated at 115 such that the survey sensor 120 also rotates with the drill string. In example embodiments, the survey sensor 120 may include a single accelerometer, a single magnetometer, and/or a single gyroscopic sensor. As depicted, the sensory axis (direction) 122 of the survey sensor 120 is angularly offset (tilted) from the longitudinal axis 112 of the collar 110 by the non-zero angle $\alpha$. The angular offset enables the survey sensor 120 to be sensitive to both axial and radial (cross-axial) components of the measured field (e.g., axial and radial components of a gravitational field for an accelerometer or axial and radial components of a magnetic field for a magnetometer).

FIG. 2B depicts an example embodiment including a single accelerometer 130 and a single magnetometer 140 deployed in a drill collar 110. As depicted, the sensory axis 132 of the accelerometer 130 is angularly offset from the longitudinal axis 112 of the collar 110 by the angle $\alpha_A$. Likewise, the sensory axis 142 of the magnetometer 140 is angularly offset from the longitudinal axis 112 of the collar 110 by the angle $\alpha_M$. The angles $\alpha_A$ and $\alpha_M$ may be the same or may be different. The disclosed embodiments are not limited in this regard.

The disclosed accelerometer and magnetometer (e.g., accelerometer 130, and magnetometer 140) may include substantially any type and configuration accelerometer or magnetometer. For example, a suitable accelerometer may include, for example, a conventional Q-flex type accelerometer or micro-electro-mechanical systems (MEMS) solid-state accelerometer. A suitable magnetometer may include, for example, a conventional ring core flux gate magnetometer or magnetoresistive sensor.

The downhole tool may further include a controller 144 that is configured to compute the wellbore inclination and the wellbore azimuth from accelerometer measurements and magnetometer measurements using the single angularly offset accelerometer 130 and/or the single angularly offset magnetometer 140. A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) and compute wellbore inclination and azimuth as described in more detail below (e.g., with respect to FIG. 3). A suitable controller may also optionally include other controllable components, such as sensors (e.g., a temperature sensor), data storage devices, power supplies, timers, and the like. The controller may also be disposed to be in electronic communication with the accelerometer(s) and magnetometer(s). A suitable controller may also optionally communicate with other instruments in the drill string, such as, for example, telemetry systems that communicate with the surface. A suitable controller may further optionally include volatile or non-volatile memory or a data storage device.

Figure 3:
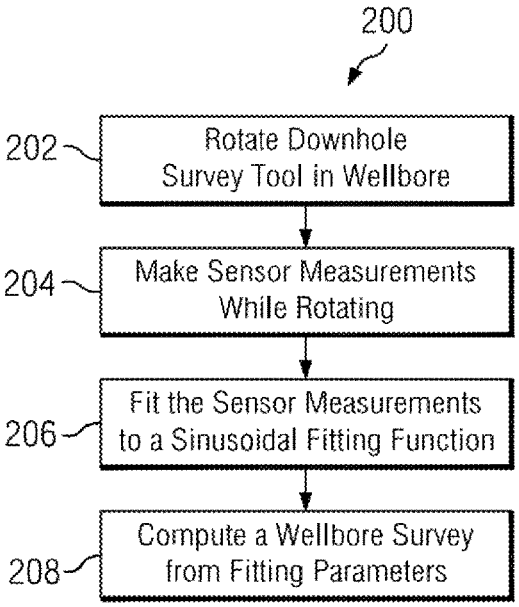
FIG. 3 depicts a flowchart of one example method for surveying a wellbore using an angularly offset survey sensor.

FIG. 3 depicts a flowchart of one example method 200 for surveying a wellbore using an angularly offset survey sensor. The method 200 includes rotating a downhole tool (such as downhole tool 100 or 100') in a wellbore at 202. The downhole tool includes a survey sensor that is angularly offset from the axis of the tool as described above with respect to FIG. 2. Sensor measurements (such as accelerometer measurements and/or magnetometer measurements) may be made while rotating at 204. The measurements may be made at any suitable measurement interval, for example, at a measurement frequency in a range from about 1 millisecond or less to about 10 milliseconds or more. The sensor measurements may be fit to a sinusoidal fitting function to obtain first and second fitting parameters (e.g., an offset parameter and a magnitude parameter) at 206. A survey parameter (such as the wellbore inclination and/or the wellbore azimuth) may be computed from the fitting parameters at 208. In example embodiments, the downhole tool may include a single angularly offset accelerometer (e.g., as depicted on FIG. 2A) and the method may include computing a wellbore inclination at 208. In other example embodiments, the downhole tool may include a single angularly offset accelerometer and a single angularly offset magnetometer (e.g., as depicted on FIG. 2B) and the method may include computing both a wellbore inclination and a wellbore azimuth at 208.

Figure 4:
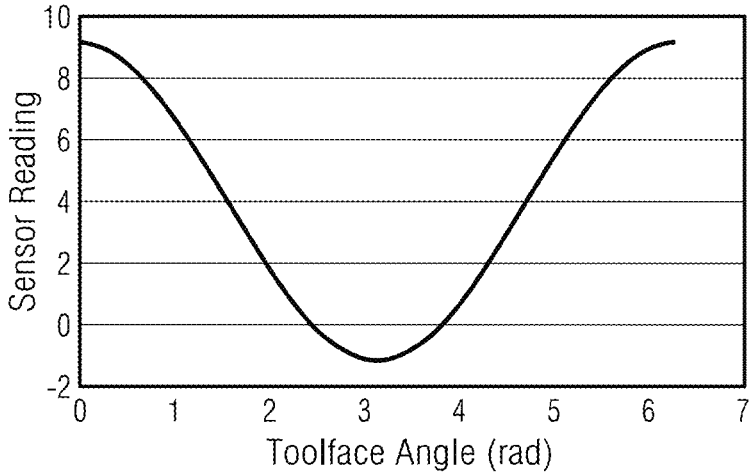
FIG. 4 depicts a plot of an example sinusoidal sensor signal resulting from rotating the downhole tool shown in FIG. 2A in a wellbore.

Turning now to FIG. 4, it will be appreciated, that rotating the drill collar 110 of the downhole tool 100, 100' in the wellbore generates a sinusoidal sensor signal with rotation (assuming that the radial component of the measured field is nonzero) such that the measurements at 204 are substantially sinusoidal with toolface. FIG. 4 depicts an example plot of one such sinusoidal sensor reading with respect to the rotational orientation (the toolface angle) of the collar 110. Note that the sensor reading is sinusoidal with the toolface angle and has a period of $2\pi$ (one full rotation of the collar).

When the survey sensor is an accelerometer, the sinusoidal signal generated from the measurements made while rotating may be expressed mathematically, for example, as follows:

$$g_{ACC} = A + B\sin\phi \tag{1}$$

where $g_{ACC}$ represents the accelerometer measurements, $\phi$ represents the gravity toolface of the collar 110, and A and B represent sinusoidal fitting parameters (the offset and magnitude of the sinusoidal signal) for the accelerometer measurements.

When the survey sensor is a magnetometer, the sinusoidal signal generated from the measurements made while rotating may be expressed mathematically, for example as follows:

$$B_{MAG} = C + D\sin\theta \tag{2}$$

where $B_{MAG}$ represents the magnetometer measurements, θ represents the magnetic toolface of the collar 110, and C and D represent sinusoidal fitting parameters (the offset and magnitude of the sinusoidal signal) for the magnetometer measurements.

The fitting parameters may be determined using substantially any suitable fitting, estimation, or regression algorithm, for example, including nonlinear least-squares, a Kalman filter, or other suitable algorithm. In the absence of noise (or non-gravitational accelerations), the accelerometer fitting parameters A and B may be related to the local gravitational field g, the offset angle $\alpha_A$ of the accelerometer 130, and the wellbore inclination I (the angle between the tool axis and the local gravitational field direction), for example, as follows:

$$A = g\cos I\cos\alpha_A \qquad (3)$$

$$B = g\sin I\sin\alpha_A$$

These first and second fitting parameters A and B may be used to calculate axial $G_{axial}$ and radial $G_{radial}$ components of the gravitational field as well as the total measured gravitational field $G_{total}$ as follows:

$$G_{axial} = \frac{A}{\cos\alpha_A} \qquad (4)$$

$$G_{radial} = \frac{B}{\sin\alpha_A}$$

$$G_{total} = \sqrt{\left(\frac{A}{\cos\alpha_A}\right)^2 + \left(\frac{B}{\sin\alpha_A}\right)^2}$$

The wellbore inclination may then be computed at 208, for example, as follows:

$$I = a\sin\left(\frac{G_{axial}}{G_{total}}\right) = a\sin\left(\frac{1}{\sqrt{\left(\frac{A}{B}\tan\alpha_A\right)^2 + 1}}\right) \qquad (5)$$

In the absence of magnetic interference, the magnetometer fitting parameters C and D may be related to the local Earth's magnetic field b, the offset angle $\alpha_M$ of the magnetometer 140, and the angle between the tool axis and the local magnetic field direction γ, for example, as follows:

$$C = b\cos\gamma\cos\alpha_M \qquad (6)$$

$$D = b\sin\gamma\sin\alpha_M$$

The first and second fitting parameters C and D may be used to calculate axial $B_{axial}$ and radial $B_{radial}$ components of the magnetic field as well as the total measured magnetic field $B_{total}$ and the angle γ, for example, as follows:

$$B_{axial} = \frac{C}{\cos\alpha_M} \qquad (7)$$

$$B_{radial} = \frac{D}{\sin\alpha_M}$$

-continued $$B_{total} = \sqrt{\left(\frac{C}{\cos\alpha_M}\right)^2 + \left(\frac{D}{\sin\alpha_M}\right)^2}$$

$$\gamma = a\sin\frac{1}{\sqrt{\left(\frac{C}{D}\tan\alpha_M\right)^2 + 1}}$$

It will be appreciated the frequencies of the sinusoids generated by the accelerometer measurements and by the magnetometer measurements are generally identical (since they are determined by the rotational frequency of the drill string) and that the phase difference between the two sinusoids is equal to the difference between the gravity toolface and the magnetic toolface. The phase difference may be determined, for example, by comparing the phase values obtained from a Kalman filter or a Fast Fourier Transform (FFT). This may be expressed mathematically, $$X = \phi - \theta \qquad (8)$$

where X is commonly referred to in the industry as angle X and represents the difference between the gravity toolface ϕ and the magnetic toolface θ. The wellbore azimuth A may be computed using the following equation:

$$A = \frac{\sin X\sin\gamma}{\cos\gamma\sin I - \sin\gamma\cos X\cos I} \qquad (9)$$

With reference again to FIG. 2, the offset angle α (e.g., $\alpha_A$ and/or $\alpha_M$) may be substantially any suitable angle between 0 and 90 degrees. In practical embodiments, the offset angle α may be selected (or set) to optimize a number of parameters including, for example, sensitivity to both axial and radial components of the measured field, the ratio of radial to axial noise experienced during a drilling operation, and the wellbore attitude. As known to those of ordinary skill, an offset angle in a range from about 30 to about 60 degrees may provide the maximum sensitivity to both the axial and radial components of the measured field. However, in drilling operations the radial noise (particularly accelerometer noise) is often greater than the axial noise (up to several times greater). Reducing the angular offset may therefore reduce the impact of such radial noise. Therefore, in certain example embodiments, the survey sensor may have an angular offset in a range from about 15 to about 60 degrees (e.g., from about 20 to about 50 degrees or from about 30 to about 45 degrees). In other example embodiments, the angular offset may be less than about 45 degrees.

With still further reference to FIG. 2, the sensor 120 (e.g., accelerometer 130 and/or magnetometer 140) may be configured to rotate in the collar such that the offset angle between the sensor axis and the collar axis may be adjusted or indexed. For example, the sensor 120 may be mounted in a sensor housing that is configured to rotate between first and second (or first, second, and third) angular positions (e.g., between corresponding stops) having corresponding first and second (or first, second, and third) offset angles. Such a configuration may advantageously enable the sensor offset angle to be preselected or adjusted, for example, based upon expected or encountered operational parameters in a drilling job.

Figure 5A:
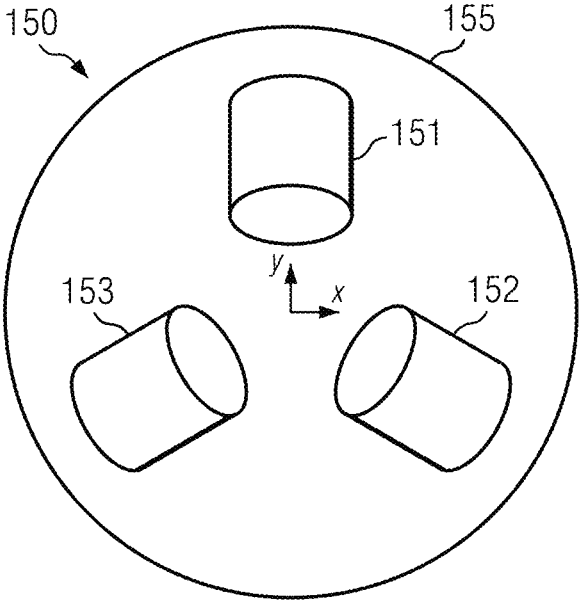
FIGS. 5A and 5B (collectively FIG. 5) schematically depict other downhole tool embodiments including first, second, and third survey sensors.
Figure 5B:
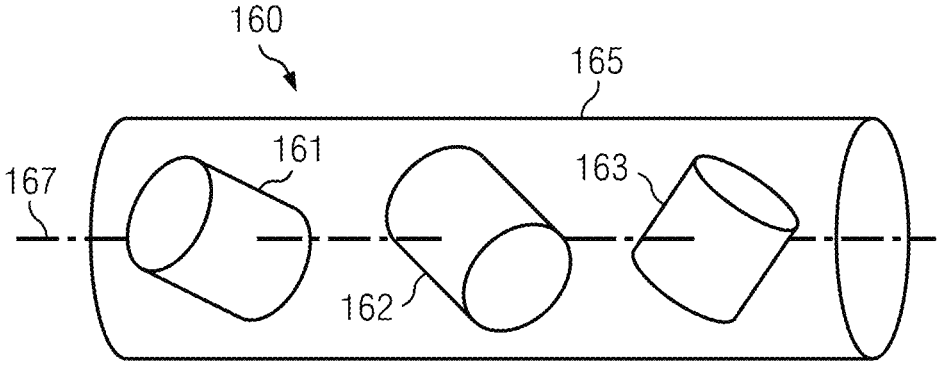

Turning now to FIGS. 5A and 5B (collectively FIG. 5), it will be appreciated that the disclosed embodiments are not limited to using a single survey sensor (e.g., a single accelerometer and/or a single magnetometer) as depicted in FIG. 2. In example embodiments, downhole tools 150 and 160 may include first, second, and third of each of the survey sensors. Such embodiments may provide redundancy and may also enable the wellbore attitude to be determined when the downhole tool is not rotating in the wellbore (such as in a static survey). FIG. 5A depicts a circular cross section of an example downhole tool 150, which includes first, second, and third tilted sensors 151, 152, 153 (e.g., accelerometers and/or magnetometers) deployed in a conical configuration at a single axial location in collar 155. In FIG. 5B, downhole tool 160 includes first, second, and third tilted sensors 161, 162, 163 (e.g., accelerometers and/or magnetometers) that are axially spaced apart from one another in the collar 165. As further depicted, the first, second, and third sensors (151, 152, 153 or 161, 162, 163) are rotationally offset from one another with respect to a radial reference direction (e.g., the x-axis). In other words, each of the sensors is rotationally offset with respect to the longitudinal axis 167 of the downhole tool and further rotationally offset from one another with respect to the radial reference direction (e.g., the x-axis). Example embodiments may further include first, second, and third accelerometers and first, second, and third magnetometers in a conical configuration (as in FIG. 5A) and/or an axially spaced configuration (as in FIG. 5B).

With continued reference to FIG. 5, when the first, second, and third sensors (151, 152, 153 or 161, 162, 163) are accelerometers, the first, second, and third accelerometer measurements $g_1$, $g_2$, and $g_3$ may be represented mathematically, for example, as follows:

$$g_1 = g\cos I\cos\alpha_{A1} + g\sin I\sin\alpha_{A1}\sin(\beta_1 + \phi) \tag{10}$$
$$g_2 = g\cos I\cos\alpha_{A2} + g\sin I\sin\alpha_{A2}\sin(\beta_2 + \phi)$$
$$g_3 = g\cos I\cos\alpha_{A3} + g\sin I\sin\alpha_{A3}\sin(\beta_3 + \phi)$$

where $\alpha_{A1}$, $\alpha_{A2}$, and $\alpha_{A3}$ represent the offset angles of the first, second, and third accelerometers and $\beta_1$, $\beta_2$, and $\beta_3$ represent the angular orientation of the radial component of the sensor measurement with respect to the radial reference direction. Note that in this configuration (and as depicted on FIGS. 5A and 5B) $\beta_1 \neq \beta_2 \neq \beta_3$. Moreover, while $\alpha_{A1} = \alpha_{A2} \times \alpha_{A3}$ in the examples depicted in FIGS. 5A and 5B, the disclosed embodiments are expressly not limited in this regard. In example embodiments it may be advantageous to employ a sensor configuration in which $\alpha_{A1} \neq \alpha_{A2} \neq \alpha_{A3}$ such that at least one of the sensors has a most favorable offset angle in accordance with the expected drilling parameters.

Using x-, y-, and z-axis convention (where the z-axis is coincident with the collar axis), the contribution of each sensor to the x-, y-, and z-axis measurements is as given in Table 1.

TABLE 1

| Sensor | x-axis contribution | y-axis contribution | z-axis contribution |
|---|---|---|---|
| 1 | Sin ($\alpha_{A1}$) cos($\beta_1$) | Sin ($\alpha_{A1}$) sin($\beta_1$) | Cos ($\alpha_{A1}$) |
| 2 | Sin ($\alpha_{A2}$) cos($\beta_1$) | Sin ($\alpha_{A2}$) sin($\beta_1$) | Cos($\alpha_{A2}$) |
| 3 | Sin ($\alpha_{A3}$) cos($\beta_1$) | Sin ($\alpha_{A3}$) sin($\beta_1$) | Cos($\alpha_{A3}$) |

The computationally most simple implementation (least computationally intensive) is to space the sensors apart by 120 degrees (⅔ pi radians) and incline (angularly offset) them such that $$\beta_1 = 0,\ \beta_2 = \frac{2}{3}\pi,\ \beta_3 = -\frac{2}{3}\pi \text{ and } \alpha_{A1} = \alpha_{A2} = \alpha_{A3} = a\cos\left(\sqrt{\frac{1}{3}}\right) \approx 54.7 \text{ degrees.}$$

However, the disclosed embodiments are, of course, not limited in this regard. As described above, in example embodiments, the offset angle may advantageously be less than about 45 degrees.

With still further reference to FIG. 5, when the first, second, and third sensors (151, 152, 153 or 161, 162, 163) are magnetometers, the first, second, and third magnetometer measurements $B_1$, $B_2$, and $B_3$ may be represented mathematically, for example, as follows:

$$B_1 = b\cos I\cos\alpha_{M1} + b\sin I\sin\alpha_{M1}\sin(\beta_1 + \phi) \tag{11}$$
$$B_2 = b\cos I\cos\alpha_{M2} + b\sin I\sin\alpha_{M2}\sin(\beta_2 + \phi)$$
$$B_3 = b\cos I\cos\alpha_{M3} + b\sin I\sin\alpha_{M3}\sin(\beta_3 + \phi)$$

where $\alpha_{M1}$, $\alpha_{M2}$, and $\alpha_{M3}$ represent the offset angles of the first, second, and third magnetometers and $\beta_1$, $\beta_2$, and $\beta_3$ represent the angular orientation of the radial component of the sensor measurement with respect to the radial reference direction. Likewise, x-, y-, and z-axis magnetometer measurements may also be computed as described above.

With continued reference to Eqs. (10) and (11), it will be appreciated that the first, second, and third sensor measurements are sinusoidal and of the same form described above with respect to Eqs. (1) and (2). Therefore, it will further be appreciated that the wellbore inclination and azimuth may likewise be computed as described above with respect to Eqs. (4), (5), and (7) where A, B, C, and D may be obtained via fitting equations 10 and 11 with sinusoidal functions as described above.

With yet further reference to FIG. 5B, deploying multiple (e.g., three) sensors along the axis of the collar (e.g., as depicted) may enable the dogleg severity (DLS) or collar bend to be quantified. For example, the wellbore inclination and/or wellbore azimuth may be computed independently at first and second axially spaced sensors (e.g., as described above). A change in the wellbore inclination and/or the wellbore azimuth may then be computed from the independent first and second measurements. This change may then be divided by the known axial distance between the spaced apart sensors to compute the DLS. The DLS may be expressed, for example, as a build rate (a change in inclination) and/or a turn rate (a change in azimuth) or as a DLS magnitude (which is related to the radius of curvature) and a DLS toolface (the direction in which the collar is turning). The build rate, turn rate, DLS magnitude, and DLS toolface may be expressed mathematically from the independent inclination and azimuth measurements, for example, as follows:

$$\text{Build} = \frac{I_2 - I_1}{L} \tag{12}$$

-continued $$\text{Turn} = \frac{A_2 - A_1}{L}$$

$$DLS_{magnitude} = \frac{\sqrt{(I_2 - I_1)^2 + \sin(I_1)\cdot\sin(I_2)\cdot(A_2 - A_1)^2}}{L}$$

$$DLS_{TF} = a\tan\left[\frac{\sin(I_2)\cdot\sin(A_2 - A_1)}{\cos(I_1)\cdot\sin(I_1)\cdot\cos(A_2 - A_1) - \sin(I_1)\cdot\cos(I_2)}\right]$$

where $I_1$ and $I_2$ represent the computed inclination at the first and second sensors and $A_1$ and $A_2$ represent the computed azimuth at the first and second sensors. It will be appreciated that after the DLS is calculated, a rotation matrix may be optionally applied to each sensor to allow the combining of sensor data to still give improved confidence from noise error reduction and calculate instantaneous orientation if three or more sensors are used.

Figure 6:
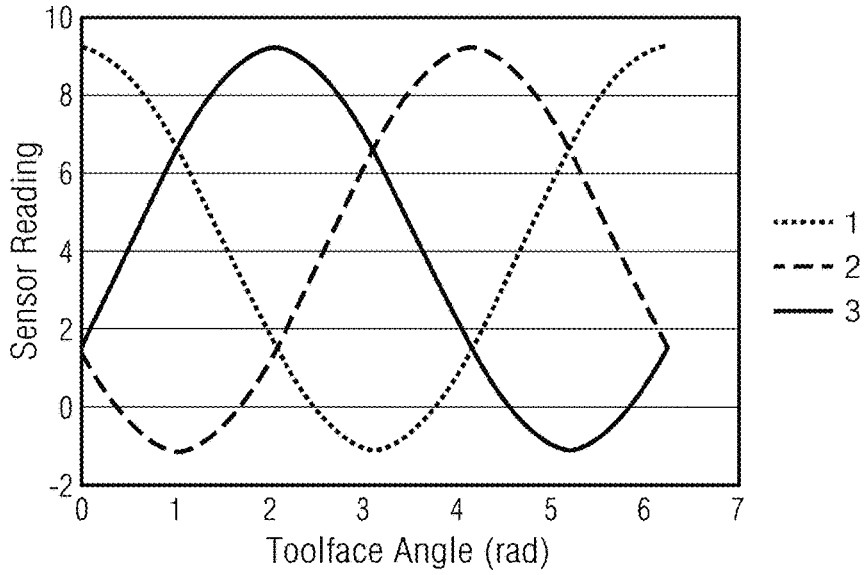
FIG. 6 depicts a plot of example sinusoidal sensor signals resulting from rotating one of the downhole tools shown in FIG. 5 in a wellbore.

FIG. 6 depicts an example plot of first, second, and third sinusoidal sensor readings for an example tool embodiment including first, second, and third sensors that are angularly spaced apart with respect to a radial reference direction (e.g., as depicted on FIGS. 5A and 5B). As described above, each of the sensor readings is sinusoidal with toolface and has a period of $2\pi$ (one full rotation of the collar). Moreover, the first, second, and third sensor readings are phase separated as indicated (with the phase separation being 120 degrees in this example) owing to the rotational orientations of the sensors.

Figure 7:
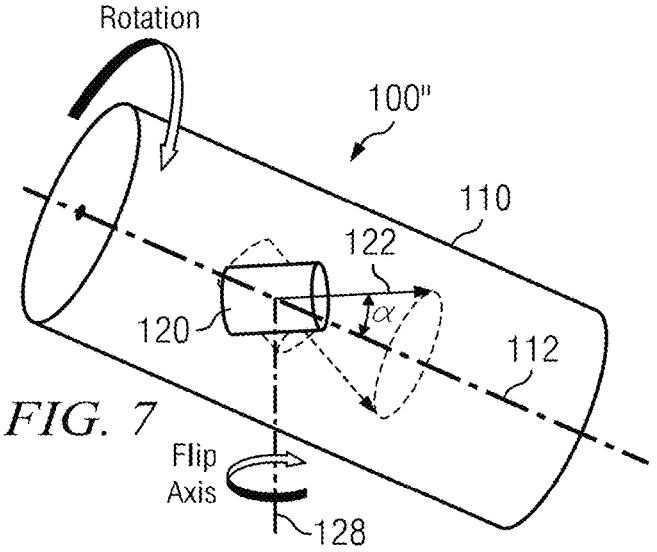
FIG. 7 depicts yet another example embodiment of the downhole tool shown on FIG. 1.

With reference again to FIGS. 2 and 5, and further reference to FIG. 7, in downhole tool 100" one or more of the rotationally offset sensors 120 may be optionally further configured to rotate about a corresponding indexing axis 128, for example, through a 180-degree rotation. Such rotation may be accomplished using substantially any suitable rotary mechanism. For example, an electric motor (not shown) may be rotationally coupled with the sensor 120 and configured to rotate the sensor about the indexing axis 128 (also referred to as a flip axis) as indicated. Sensor measurements may be made at two distinct rotational positions with respect to the flip axis that are, for example, 180 degrees apart from one another. A bias corrected measurement may be determined, for example, by calculating a difference between the two measurements (made at the two rotational positions) and then dividing the difference by two. Moreover, the magnitude of the bias may be determined, for example, by calculating a sum of the two measurements and then dividing the sum by two. This bias may then be subtracted from future sensor measurements.

In example embodiments that make use of multiple sensors, a scale factor between the sensors may be equalized by calculating the magnitude of the sinusoid produced and adjusting the gains of each sensor to provide the same sinusoidal amplitude. Additionally, if only one sensor is configured to rotate (to flip 180 degrees), the bias of the other sensors may be adjusted to match the one calibrated sensor. In this way, inexpensive sensors with unpredictable bias and scale factor errors may be advantageously used to produce definitive downhole surveys providing they exhibit good linearity.

With further reference to FIG. 7, and as described above with respect to FIGS. 2-6, the same sensor (e.g., sensor 120) may be rotated about the tool axis to provide multiple measurements at multiple corresponding angles that can be used to compute the wellbore survey. It will be appreciated that these measurements have the same scale factor (since they were made by the same sensor) and that this scale error cancels when determining an angle within a field or determining the axis of the Earth's rotation with respect to the tool axis. Combining these methods of canceling sensor bias and sensor scale factor error may advantageously greatly increase survey accuracy and may enable low cost sensors having unpredictable bias and scale factor errors to be used to make accurate wellbore surveys.

With still further reference to FIG. 7, when sensor 120 is a gyroscopic sensor that is sensitive to rotation, the sensor measurements may be taken at a series of static rotational angles (e.g., three or more) about rotational axis 112. These gyroscopic measurements may then be combined through a fitting algorithm or a transformation matrix to compute a corresponding three axis survey (e.g., including x-, y-, and z-axis rotational components). The wellbore inclination and azimuth may then be computed from the three-axis survey using equations known to those of skill in gyroscopic surveying.

The disclosed embodiments may further include calibrating the offset angle of the tilted sensor. It will be appreciated that a tilted survey sensor (such as described above) may be misaligned in the downhole tool such that the actual offset angle is not exactly equal to the desired or expected offset angle. The downhole tool may be calibrated, for example, by deploying the downhole tool at a known orientation with respect to a known gravitational field vector and/or a known magnetic field vector (such that I and/or $\gamma$ are known). Rotating the tool and making sensor measurements then enables the offset angle $\alpha$ to be computed (calibrated).

Figure 8:
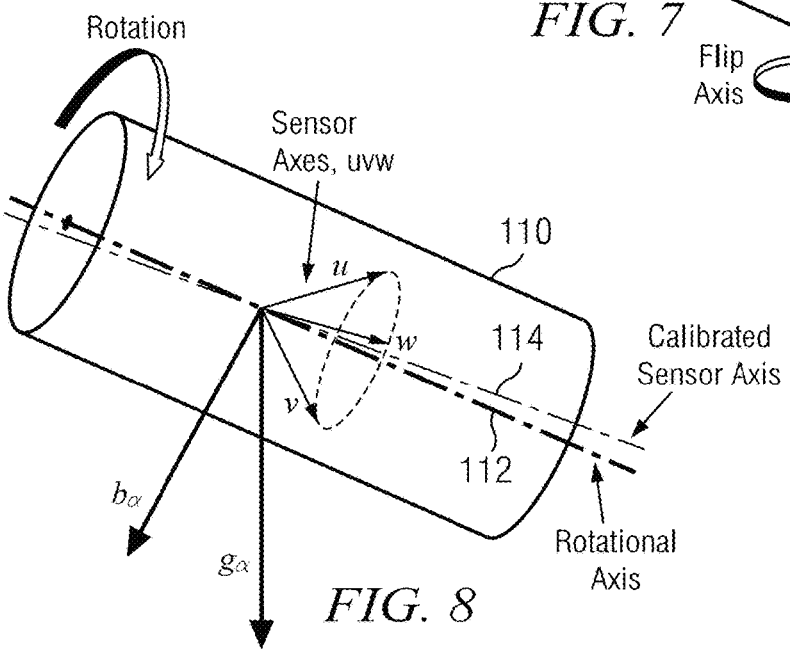
FIG. 8 schematically depicts first, second, and third sensors deployed in a collar.

In certain example embodiments, the use of multiple sensors (e.g., multiple accelerometers and/or multiple magnetometers) may enable a more accurate calibration of the offset angles of the tilted sensors. FIG. 8 schematically depicts first, second, and third sensors having corresponding sensor axes u, v, and w deployed in a collar 110. Example gravitational field directions $g_\alpha$ and magnetic field directions $b_\alpha$ are also shown. It will be appreciated that there may be misalignment between the actual axis 114 of the calibrated sensor unit and the longitudinal (rotational) axis 112 of the collar and that this misalignment can be non-negligible when a high precision survey is desired. As depicted, the reference signals $g_\alpha$ and $b_\alpha$ may look like a circle rotating around the rotational axis of the collar.

Figure 9A:
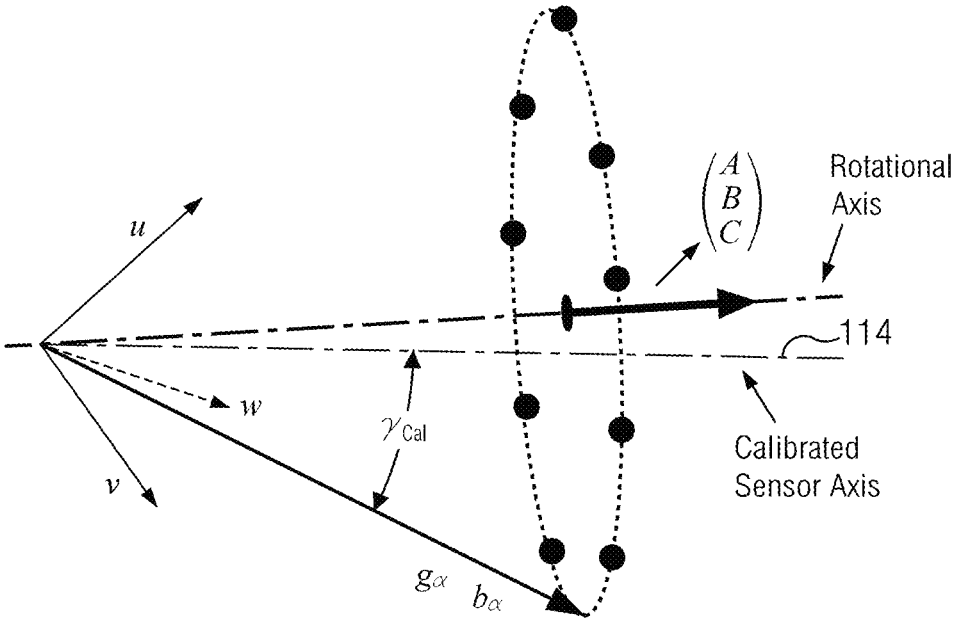
FIGS. 9A and 9B schematically depict the first, second, and third sensors shown on FIG. 8 in which the angle $\gamma_{cal}$ is large (9A) and small (9B).
Figure 9B:
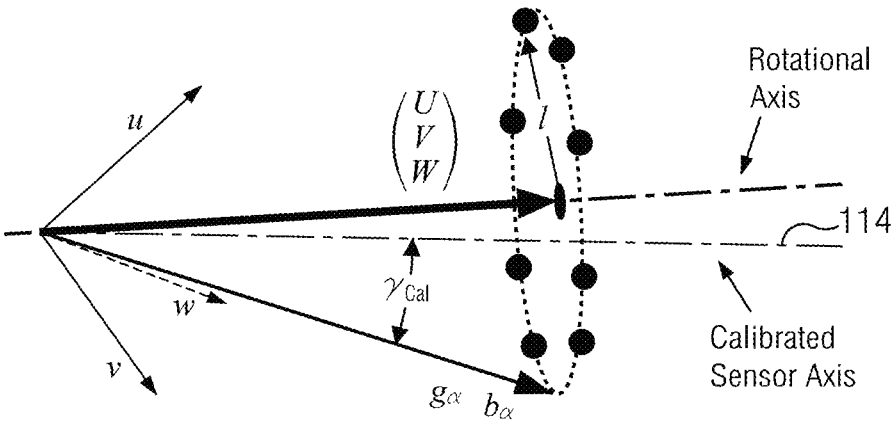

Turning now to FIGS. 9A and 9B (collectively FIG. 9), the sensor offset angles may be calibrated downhole, for example, using the following procedure. Using multiple sensor $v$ measurements from each sensor, the rotational axis vector ($u=[u\ v\ w]^T$) may be determined one of two ways as follows: First, when the angle $\gamma_{cal}$ between $g_\alpha$ and/or $b_\alpha$ and the calibrated axis 114 is large (as in FIG. 9A), then $$As_u^i + Bs_v^i + Cs_w^i - 1 = 0 \tag{13}$$

where A, B, C represent parameters defining a plane and $$s_u^i,\ s_v^i,\ \text{and}\ s_w^i$$

represent the ith sensor measurement of reference. Summing up multiple measurements:

$$\begin{pmatrix} s_u^1 & s_v^1 & s_w^1 \\ \vdots & \vdots & \vdots \\ s_u^n & s_u^n & s_u^n \end{pmatrix}\begin{pmatrix} A \\ B \\ C \end{pmatrix} = \begin{pmatrix} 1 \\ \vdots \\ 1 \end{pmatrix} \tag{14}$$

such that the rotational axis can be given as follows:

$$\begin{pmatrix} A \\ B \\ C \end{pmatrix} = \left( \begin{pmatrix} s_u^1 & s_v^1 & s_w^1 \\ \vdots & \vdots & \vdots \\ s_u^n & s_u^n & s_u^n \end{pmatrix}^T \begin{pmatrix} s_u^1 & s_v^1 & s_w^1 \\ \vdots & \vdots & \vdots \\ s_u^n & s_u^n & s_u^n \end{pmatrix} \right)^{-1} \begin{pmatrix} s_u^1 & s_v^1 & s_w^1 \\ \vdots & \vdots & \vdots \\ s_u^n & s_u^n & s_u^n \end{pmatrix}^T \begin{pmatrix} 1 \\ \vdots \\ 1 \end{pmatrix} \tag{15}$$

and the rotational axis with unit vector is given as follows:

$$\begin{pmatrix} u \\ v \\ w \end{pmatrix} = \frac{1}{\sqrt{A^2 + B^2 + C^2}} \begin{pmatrix} A \\ B \\ C \end{pmatrix} \tag{16}$$

Second, when the angle $\gamma_{cal}$ between $g_\alpha$ and/or $b_\alpha$ and the calibrated axis 114 is small (as in FIG. 9B), then assuming $$\begin{pmatrix} U \\ V \\ W \end{pmatrix}$$

is the vector pointing to the center of the rotating reference, each measurement point may follow the following equation:

$$(s_u^i - U)^2 + (s_v^i - V)^2 + (s_w^i - W)^2 - l^2 = 0 \tag{17}$$

where l represents the radius of the circle. The parameters U, V, W and l can be estimated by a non-linear optimization for the multiple point measurement. Here, rotational axis with unit vector can be described as follows:

$$\begin{pmatrix} u \\ v \\ w \end{pmatrix} = \frac{1}{\sqrt{U^2 + V^2 + W^2}} \begin{pmatrix} U \\ V \\ W \end{pmatrix} \tag{18}$$

After estimating the rotational axis of the sensor unit as described above, the obtained vector $$\begin{pmatrix} u \\ v \\ w \end{pmatrix}$$

may be used to update the sensor angle $\alpha$ for each sensor, for example, as follows:

$$\cos\alpha_1 = (1 \quad 0 \quad 0)\begin{pmatrix} u \\ v \\ w \end{pmatrix}, \alpha_1 = a\cos u \tag{19}$$

$$\cos\alpha_2 = (0 \quad 1 \quad 0)\begin{pmatrix} u \\ v \\ w \end{pmatrix}, \alpha_2 = a\cos v$$

$$\cos\alpha_3 = (0 \quad 0 \quad 1)\begin{pmatrix} u \\ v \\ w \end{pmatrix}, \alpha_3 = a\cos w$$

Should one or more of the sensors fail, accurate surveys may be conducted, for example, as described above using the corresponding calibrated offset angle ($\alpha_1$, $\alpha_2$, or $\alpha_3$).

It will be understood that the present disclosure includes numerous embodiments. These embodiments include, but are not limited to, the following embodiments.

In a first embodiment, a method for surveying a wellbore includes rotating a downhole tool in the wellbore, the downhole tool including a tilted survey sensor, the tilted survey sensor having a sensory axis that is rotationally offset from a longitudinal axis of the downhole tool; using the tilted survey sensor to make a plurality of sensor measurements while rotating the downhole tool in the wellbore; fitting the plurality of sensor measurements with a sinusoidal fitting function to obtain first and second fitting parameters; and computing a wellbore survey parameter from the first and second fitting parameters.

A second embodiment may include the first embodiment, wherein the plurality of sensor measurements is made using a single tilted accelerometer; and the wellbore survey parameter comprises a wellbore inclination.

A third embodiment may include the second embodiment, wherein the wellbore inclination is computed from the first and second fitting parameters and an offset angle between a sensory axis of the single accelerometer and the longitudinal axis of the downhole tool.

A fourth embodiment may include any one of the first through third embodiments, wherein the plurality of sensor measurements comprises a first plurality of sensor measurements and a second plurality of sensor measurements, the first plurality of sensor measurements being made using a single tilted accelerometer and the second plurality of sensor measurements being made using a single tilted magnetometer; the first plurality of sensor measurements is fit with a first sinusoidal function to obtain the first and second fitting parameters and the second plurality of sensor measurements is fit with a second sinusoidal function to obtain third and fourth fitting parameters; and the wellbore survey parameter comprises a wellbore inclination and a wellbore azimuth.

A fifth embodiment may include the fourth embodiment, wherein the first and second fitting parameters are related to the wellbore inclination and an offset angle between a sensory axis of the accelerometer and the longitudinal axis of the downhole tool; and the third and fourth fitting parameters are related to an angle between the longitudinal axis of the downhole tool and a local magnetic field direction and an offset angle between a sensory axis of the magnetometer and the longitudinal axis of the downhole tool.

A sixth embodiment may include the fifth embodiment, further comprising computing a phase difference between the first sinusoidal function and the second sinusoidal function to determine a difference between a gravity toolface and a magnetic toolface of the downhole tool.

A seventh embodiment may include the sixth embodiment, wherein the wellbore inclination is computed from the first and second fitting parameters and an offset angle between a sensory axis of the single accelerometer and the longitudinal axis of the downhole tool; the angle between the longitudinal axis of the downhole tool and a local magnetic field direction is computed from the third and fourth fitting parameters and an offset angle between a sensory axis of the single magnetometer and the longitudinal axis of the downhole tool; and the wellbore azimuth is computed from the wellbore inclination, the angle between the longitudinal axis of the downhole tool and a local magnetic field direction, and the difference between the gravity toolface and the magnetic toolface.

An eighth embodiment may include any one of the first through seventh embodiments, wherein the downhole tool includes first, second, and third tilted accelerometers and first, second, and third tilted magnetometers, wherein the first, second, and third tilted accelerometers are rotationally offset from one another with respect to a radial reference direction and the first, second, and third tilted magnetometers are rotationally offset from one another with respect to the radial reference; the using the tilted survey sensor comprises using each of the tilted accelerometers and each of the tilted magnetometers to make corresponding pluralities of sensor measurements while rotating the downhole tool; the fitting comprises fitting each of the pluralities of sensor measurements with a corresponding sinusoidal fitting function to obtain corresponding first and second fitting parameters; and the computing comprises computing first, second, and third wellbore inclination values and first, second, and third wellbore azimuth values from the corresponding first and second fitting parameters.

A ninth embodiment may include the eighth embodiment, further comprising making first, second, and third non-rotating accelerometer measurements using the first, second, and third accelerometers and first, second, and third non-rotating magnetometer measurements while the downhole tool is rotationally stationary in the wellbore; and computing a wellbore inclination and a wellbore azimuth from the first, second, and third non-rotating accelerometer measurements and the first, second, and third non-rotating magnetometer measurements.

A tenth embodiment may include any one of the eighth through ninth embodiments, wherein the first, second, and third tilted accelerometers and the first, second, and third tilted magnetometers are axially spaced apart in the downhole tool; and the method further comprises computing a dogleg severity of the wellbore from selected ones of the first, second, and third wellbore inclination values and the first, second, and third wellbore azimuth values.

In an eleventh embodiment, a downhole tool comprises a collar configured for coupling with a drill string; a tilted survey sensor deployed in the collar, the tilted survey sensor having a sensory axis that is rotationally offset from a longitudinal axis of the collar; and a controller configured to: cause the tilted survey sensor to make a plurality of sensor measurements while the downhole tool rotates in a wellbore; fit the plurality of sensor measurements with a sinusoidal fitting function to obtain first and second fitting parameters; and compute a wellbore survey parameter from the first and second fitting parameters.

A twelfth embodiment may include the eleventh embodiment, wherein the tilted survey sensor comprises a tilted accelerometer and a tilted magnetometer; the plurality of sensor measurements comprises a first plurality of sensor measurements and a second plurality of sensor measurements, the first plurality of sensor measurements being made using the tilted accelerometer and the second plurality of sensor measurements being made using the tilted magnetometer; the first plurality of sensor measurements is fit with a first sinusoidal function to obtain the first and second fitting parameters and the second plurality of sensor measurements is fit with a second sinusoidal function to obtain third and fourth fitting parameters; and the wellbore survey parameter comprises a wellbore inclination and a wellbore azimuth.

A thirteenth embodiment may include the twelfth embodiment, wherein the tilted accelerometer comprises first, second, and third axially spaced tilted accelerometers and the tilted magnetometer comprises first, second, and third axially spaced tilted magnetometers, wherein the first, second, and third tilted accelerometers are rotationally offset from one another with respect to a radial reference direction and the first, second, and third tilted magnetometers are rotationally offset from one another with respect to the radial reference; the controller is configured to cause each of the tilted accelerometers and each of the tilted magnetometers to make corresponding pluralities of sensor measurements while the downhole tool rotates in the wellbore; the controller is configured to fit each of the pluralities of sensor measurements with a corresponding sinusoidal fitting function to obtain corresponding fitting parameters; the controller is configured to compute first, second, and third wellbore inclination values and first, second, and third wellbore azimuth values from the corresponding fitting parameters; and the controller is further configured to compute a dogleg severity of the wellbore from selected ones of the first, second, and third wellbore inclination values and the first, second, and third wellbore azimuth values.

A fourteenth embodiment may include any one of the eleventh through thirteenth embodiments, wherein the tilted survey sensor is configured to rotate between at least first and second angular positions having corresponding first and second offset angles.

A fifteenth embodiment may include any one of the eleventh through fourteenth embodiments, wherein the tilted survey sensor is rotationally offset from the longitudinal axis of the collar by an angular offset of less than about 45 degrees.

In a sixteenth embodiment, a method for surveying a wellbore comprises rotating a downhole tool in the wellbore, the downhole tool including first, second, and third tilted accelerometers and first, second, and third tilted magnetometers, each of the first, second, and third tilted accelerometers and first, second, and third tilted magnetometers having a sensory axis that is rotationally offset from a longitudinal axis of the downhole tool, wherein the first, second, and third tilted accelerometers are rotationally offset from one another with respect to a radial reference direction and the first, second, and third tilted magnetometers are rotationally offset from one another with respect to the radial reference; using the first, second, and third tilted accelerometers and first, second, and third tilted magnetometers to make corresponding first, second, and third pluralities of accelerometer measurements and first, second, and third pluralities of magnetometer measurements while rotating the downhole tool in the wellbore; fitting the first, second, and third pluralities of accelerometer measurements with first, second, and third sinusoidal fitting functions to obtain corresponding accelerometer fitting parameters; fitting the first, second, and third pluralities of magnetometer measurements with fourth, fifth, and sixth sinusoidal fitting functions to obtain corresponding magnetometer fitting parameters; and computing first, second, and third wellbore inclination values and first, second, and third wellbore azimuth values from selected ones of the accelerometer fitting parameters and the magnetometer fitting parameters.

A seventeenth embodiment may include the sixteenth embodiment, further comprising making first, second, and third non-rotating accelerometer measurements using the first, second, and third accelerometers and first, second, and third non-rotating magnetometer measurements using the first, second, and third magnetometers while the downhole tool is rotationally stationary in the wellbore; and computing a static wellbore inclination and a static wellbore azimuth from the first, second, and third non-rotating accelerometer measurements and the first, second, and third non-rotating magnetometer measurements.

An eighteenth embodiment may include any one of the sixteenth through seventeenth embodiments, wherein the first, second, and third tilted accelerometers and the first, second, and third tilted magnetometers are axially spaced apart in the downhole tool; and the method further comprises computing a dogleg severity of the wellbore from selected ones of the first, second, and third wellbore inclination values and the first, second, and third wellbore azimuth values.

A nineteenth embodiment may include any one of the sixteenth through eighteenth embodiments, further comprising computing an average wellbore inclination from the first, second, and third wellbore inclination values; and computing an average wellbore azimuth from the first, second, and third wellbore azimuth values.

A twentieth embodiment may include any one of the sixteenth through nineteenth embodiments, wherein the computing further comprises computing the first, second, and third wellbore inclination values from the corresponding accelerometer fitting parameters and offset angles between sensory axes of the first, second, and third accelerometers and the longitudinal axis of the downhole tool; computing first, second, and third phase differences between the first, second, and third sinusoidal functions and the fourth, fifth, and sixth sinusoidal functions; computing an angle between the longitudinal axis of the downhole tool and a local magnetic field direction from the corresponding magnetometer fitting parameters and offset angles between sensory axes of the first, second, and third magnetometers and the longitudinal axis of the downhole tool; computing the first, second, and third wellbore azimuth values from the first, second, and third wellbore inclination values, the angle between the longitudinal axis of the downhole tool and a local magnetic field direction, and the first, second, and third phase differences.

Although wellbore surveying using a tilted survey sensor and certain advantages thereof have been described in detail, it should be understood that various changes, substitutions and alterations may be made herein without departing from the spirit and scope of the disclosure.

The invention claimed is:

1. A method for surveying a wellbore while drilling, the method comprising:

rotating a downhole tool in the wellbore while drilling the wellbore, the downhole tool including at least one tilted survey sensor, wherein the at least one tilted survey sensor includes a tilted accelerometer and a tilted magnetometer, wherein the tilted accelerometer has a sensory axis that is rotationally offset from a longitudinal axis of the downhole tool by a first offset angle in the range between 15 and 60 degrees where the tilted accelerometer is sensitive to both axial and radial components of a gravitational field measured by the tilted accelerometer, and wherein the tilted magnetometer has a sensory axis that is rotationally offset from the longitudinal axis of the downhole tool by a second offset angle in the range between 15 and 60 degrees where the tilted magnetometer is sensitive to both axial and radial components of a magnetic field measured by the tilted magnetometer, configuring the at least one tilted survey sensor to make a plurality of sensor measurements while rotating the downhole tool in the wellbore and drilling the wellbore, wherein the plurality of sensor measurements comprises a first plurality of sensor measurements and a second plurality of sensor measurements, the first plurality of sensor measurements being made using the tilted accelerometer, and the second plurality of sensor measurements being made using the tilted magnetometer;

configuring a controller to fit the first plurality of sensor measurements with a first sinusoidal fitting function to obtain first and second fitting parameters representing offset and magnitude of the first sinusoidal fitting function;

configuring the controller to fit the second plurality of sensor measurements with a second sinusoidal fitting function to obtain third and fourth fitting parameters representing offset and magnitude of the second sinusoidal fitting function;

configuring the controller to determine a first survey parameter that characterizes inclination of the wellbore and a second survey parameter that characterizes azimuth of the wellbore, wherein the first survey parameter is determined from the first and second fitting parameters and the first offset angle between the sensory axis of the tilted accelerometer and the longitudinal axis of the downhole tool; and configuring the controller to compute a phase difference between the first sinusoidal fitting function and the second sinusoidal fitting function to determine a difference between a gravity toolface and a magnetic toolface of the downhole tool, wherein an angle between the longitudinal axis of the downhole tool and a local magnetic field direction is computed from the third and fourth fitting parameters and the second offset angle between the sensory axis of the tilted magnetometer and the longitudinal axis of the downhole tool, and wherein the second survey parameter is computed from the first survey parameter, the angle between the longitudinal axis of the downhole tool and the local magnetic field direction, and the difference between the gravity toolface and the magnetic toolface.

2. A downhole tool comprising:

a collar configured for coupling with a drill string;

at least one tilted survey sensor deployed in the collar, the at least one tilted survey sensor comprising a tilted accelerometer and a tilted magnetometer, wherein the tilted accelerometer has a sensory axis that is rotationally offset from a longitudinal axis of the downhole tool by a first offset angle in the range between 15 and 60 degrees where the tilted accelerometer is sensitive to both axial and radial components of a gravitational field measured by the tilted accelerometer, and wherein the tilted magnetometer has a sensory axis that is rotationally offset from the longitudinal axis of the downhole tool by a second offset angle in the range between 15 and 60 degrees where the tilted magnetometer is sensitive to both axial and radial components of a magnetic field measured by the tilted magnetometer; and a controller configured to:

cause the tilted survey sensor to make a plurality of sensor measurements while the downhole tool rotates in a wellbore and the drill string drills the wellbore, wherein the plurality of sensor measurements comprises a first plurality of sensor measurements and a second plurality of sensor measurements, the first plurality of sensor measurements being made using the tilted accelerometer and the second plurality of sensor measurements being made using the tilted magnetometer;

fit the first plurality of sensor measurements with a first sinusoidal fitting function to obtain first and second fitting parameters representing offset and magnitude of the first sinusoidal fitting function;

fit the second plurality of sensor measurements with a second sinusoidal fitting function to obtain third and fourth fitting parameters representing offset and magnitude of the second sinusoidal fitting function;

determine a first survey parameter that characterizes inclination of the wellbore and a second survey parameter that characterizes azimuth of the wellbore, wherein the first survey parameter is determined from the first and second fitting parameters and the first offset angle between the sensory axis of the tilted accelerometer and the longitudinal axis of the downhole tool; and compute a phase difference between the first sinusoidal fitting function and the second sinusoidal fitting function to determine a difference between a gravity toolface and a magnetic toolface of the downhole tool, wherein an angle between the longitudinal axis of the downhole tool and a local magnetic field direction is computed from the third and fourth fitting parameters and the second offset angle between the sensory axis of the tilted magnetometer and the longitudinal axis of the downhole tool, and wherein the second survey parameter is computed from the first survey parameter, the angle between the longitudinal axis of the downhole tool and the local magnetic field direction, and the difference between the gravity toolface and the magnetic toolface.

3. A method for surveying a wellbore while drilling, the method comprising:

rotating a downhole tool in the wellbore while drilling the wellbore, the downhole tool including first, second, and third tilted accelerometers and first, second, and third tilted magnetometers, wherein the first, second, and third tilted accelerometers have sensory axes that are rotationally offset from a longitudinal axis of the downhole tool by respective offset angles in the range between 15 and 60 degrees where the first, second, and third tilted accelerometers are sensitive to both axial and radial components of a gravitational field measured by the first, second, and third tilted accelerometers, wherein the first, second, and third tilted magnetometers have sensory axes that are rotationally offset from the longitudinal axis of the downhole tool by respective offset angles in the range between 15 and 60 degrees where the first, second, and third tilted magnetometers are sensitive to both axial and radial components of a magnetic field measured by the first, second, and third tilted magnetometers, wherein the first, second, and third tilted accelerometers are rotationally offset from one another with respect to a radial reference direction and the first, second, and third tilted magnetometers are rotationally offset from one another with respect to the radial reference direction;

configuring the first, second, and third tilted accelerometers to make corresponding first, second, and third pluralities of accelerometer measurements while rotating the downhole tool in the wellbore and drilling the wellbore, and configuring the first, second, and third tilted magnetometers to make corresponding first, second, and third pluralities of magnetometer measurements while rotating the downhole tool in the wellbore and drilling the wellbore;

configuring a controller to fit the first, second, and third pluralities of accelerometer measurements with first, second, and third sinusoidal fitting functions to obtain corresponding accelerometer fitting parameters;

configuring the controller to fit the first, second, and third pluralities of magnetometer measurements with fourth, fifth, and sixth sinusoidal fitting functions to obtain corresponding magnetometer fitting parameters;

configuring the controller to determine first, second, and third wellbore inclination values that characterize inclination of the wellbore from the accelerometer fitting parameters and the respective offset angles between the sensory axes of the first, second, and third tilted accelerometers and the longitudinal axis of the downhole tool;

configuring the controller to determine first, second, and third wellbore azimuth values that characterize azimuth of the wellbore from the magnetometer fitting parameters and the respective offset angles between the sensory axes of the first, second, and third tilted magnetometers and the longitudinal axis of the downhole tool;

configuring the controller to compute first, second, and third phase differences between the first, second, and third sinusoidal fitting functions and the fourth, fifth, and sixth sinusoidal fitting functions;

configuring the controller to compute an angle between the longitudinal axis of the downhole tool and a local magnetic field direction from the corresponding magnetometer fitting parameters and the respective offset angles between the sensory axes of the first, second, and third tilted magnetometers and the longitudinal axis of the downhole tool; and configuring the controller to compute the first, second, and third wellbore azimuth values from the first, second, and third wellbore inclination values, the angle between the longitudinal axis of the downhole tool and the local magnetic field direction, and the first, second, and third phase differences.

4. The method of claim 3, further comprising:

configuring the first, second, and third tilted accelerometers to make first, second, and third non-rotating accelerometer measurements while the downhole tool is rotationally stationary in the wellbore, and configuring the first, second, and third tilted magnetometers to make first, second, and third non-rotating magnetometer measurements while the downhole tool is rotationally stationary in the wellbore; and configuring the controller to determine a static wellbore inclination value and a static wellbore azimuth value from the first, second, and third non-rotating accelerometer measurements and the first, second, and third non-rotating magnetometer measurements.

5. The method of claim 3, wherein:

the first, second, and third tilted accelerometers and the first, second, and third tilted magnetometers are axially spaced apart in the downhole tool; and the controller is further configured to determine a dogleg severity of the wellbore from selected ones of the first, second, and third wellbore inclination values and the first, second, and third wellbore azimuth values.

6. The method of claim 3, further comprising:

configuring the controller to compute an average wellbore inclination from the first, second, and third wellbore inclination values; and configuring the controller to compute an average wellbore azimuth from the first, second, and third wellbore azimuth values.

* * * * *